US006407807B1

(12) United States Patent
Focke et al.

(10) Patent No.: US 6,407,807 B1
(45) Date of Patent: Jun. 18, 2002

(54) METHOD AND APPARATUS FOR TESTING CIGARETTE HEADS

(75) Inventors: Heinz Focke, Verden; Ralf Sinnerbrink, Kirchlinteln; Winfried Niebler, Flintsbach a. Inn, all of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/568,344

(22) Filed: May 10, 2000

(30) Foreign Application Priority Data

May 12, 1999 (DE) ..... 199 21 721

(51) Int. Cl.[7] ..... G01N 21/55; B07C 5/342

(52) U.S. Cl. ..... 356/237.1; 356/448; 209/536; 250/223 R; 131/908

(58) Field of Search ..... 356/394, 237.1, 356/398, 445, 448; 209/588, 585, 579, 535, 536; 131/908, 94, 905; 702/168; 700/195; 33/503; 250/559.4, 559.46, 222.1, 559.45, 223 R; 382/143; 348/125

(56) References Cited

U.S. PATENT DOCUMENTS

| | | | | | |
|---|---|---|---|---|---|
| 3,557,375 | A | * | 1/1971 | Schmermund | 250/213 |
| 3,729,636 | A | * | 4/1973 | Merker | 250/223 R |
| 3,812,349 | A | * | 5/1974 | Gugliotta et al. | 250/223 R |
| 3,818,223 | A | * | 6/1974 | Gibson et al. | 250/223 R |
| 4,486,098 | A | * | 12/1984 | Buchegger et al. | 356/445 |
| 4,678,901 | A | * | 7/1987 | Focke et al. | 250/223 R |
| 4,955,948 | A | * | 9/1990 | Focke et al. | 131/280 |
| 5,103,905 | A | | 4/1992 | Brannon et al. | 166/250 |
| 5,223,915 | A | * | 6/1993 | Neri | 356/394 |
| 5,596,187 | A | * | 1/1997 | Di Stefano et al. | 250/222.1 |

FOREIGN PATENT DOCUMENTS

| | | | |
|---|---|---|---|
| DE | 3243204 | A1 * | 5/1984 |
| DE | 36 18 190 | | 12/1986 |
| DE | 38 19 653 | | 12/1988 |
| DE | 40 00 658 | | 8/1990 |
| DE | 36 38 519 | | 7/1991 |
| DE | 19921725 | A1 * | 11/2000 |
| EP | 157 086 | | 10/1985 |
| EP | 349 823 | | 1/1990 |
| EP | 518 141 | | 12/1992 |
| EP | 585 686 | | 3/1994 |
| EP | 630 586 | | 12/1994 |
| EP | 634112 | | 1/1995 |

OTHER PUBLICATIONS

Klaus Bechtel, "Beruhrungslos positionieren mit Laser", Der Konstrukteur S, 3/89, pp. 78, 80 and 82.

* cited by examiner

*Primary Examiner*—Hoa Q. Pham
(74) *Attorney, Agent, or Firm*—Sughrue Mion, PLLC

(57) ABSTRACT

The invention relates to a method for testing cigarette heads, at least one region of a cigarette head being irradiated with light, and light reflected by the cigarette head being received by a detector in such a way that irradiating and received reflected light run at an angle to one another, the irradiated region is imaged on the detector and a signal generated by the detector is evaluated. Such known methods have the disadvantage that they are inaccurate and do not permit exact statements on the state of cigarettes. The invention is therefore based on the problem of improving the testing of cigarettes. It solves this problem by virtue of the fact that, when evaluating, a possible deviation, in particular a distance, of the position of the image of the irradiated region from an expected position of an image of a corresponding region of an ideal cigarette head onto the detector is determined, the deviation being used to determine the distance of the irradiated region from a desired position of this region. The invention also relates to an apparatus for carrying out this method.

18 Claims, 3 Drawing Sheets

METHOD AND APPARATUS FOR TESTING CIGARETTE HEADS

BACKGROUND OF THE INVENTION

The invention relates to a method for testing cigarette heads, at least one region of a cigarette head being irradiated with light, and light reflected by the cigarette head being received by a detector in such a way that irradiating and received reflected light run at an angle to one another, the irradiated region is imaged on the detector and a signal generated by the detector is evaluated. The invention also relates to an apparatus for testing cigarette heads, having a light source and an optical system for producing at least one region, irradiated with light, on a cigarette head, and having a detector, for receiving light reflected by the cigarette head, which is arranged in such a way that irradiating and received reflected light run at an angle to one another and the irradiated region can be imaged on the detector.

A test method or a testing apparatus is known for contactless testing of cigarette heads, in the case of which a straight line is radiated onto a tobacco-end cigarette head. If the cigarette is not properly filled with tobacco, the line no longer appears as a straight line—if it is observed from a different viewing angle—, but as a wavy line or as a broken wavy line. This image is detected by a sensor. Finally, the image points which lie inside and outside a narrow region around an imaginary, theoretical straight line are counted and their ratio is formed. If this ratio exceeds a limiting value, this is formed to indicate that a cigarette is not properly filled.

This type of testing has the disadvantage that it is inaccurate and does not permit exact statements on the state of a cigarette. The invention is therefore based on the problem of improving the testing of cigarettes and permitting more accurate statements on the state of a cigarette.

SUMMARY OF THE INVENTION

For the purpose of solving this problem, the method according to the invention is characterized in that, when evaluating, a possible deviation, in particular a distance, of the position of the image of the irradiated region from an expected position of an image of a corresponding region of an ideal cigarette head on the detector is determined, the deviation being used to determine the distance of the irradiated region from a desired position of this region. Furthermore, the problem is solved by an apparatus according to the invention which is characterized by an evaluation device which evaluates a signal generated by the detector in order to determine a possible deviation, in particular a distance, in the position of the image of the irradiated region from an expected position of an image of a corresponding region of an ideal cigarette head, in order to determine from the deviation the distance of the irradiated region from a desired position of this region.

A cigarette head can be measured in a contactless fashion by means of the invention. In this case, it is preferred for the light beam of a laser or another bright light source to be used and focused onto a cigarette head via a lens. One or more image points are thereby illuminated essentially at the test distance. A lens focuses the reflected light on a position-sensitive detector. If the illuminated region is not located in its desired position, this leads to a deviation in the image point on the position-sensitive detector, or to a deviation in the image of the illuminated region with reference to an expected position of the image on the detector. On the basis of the geometrical arrangement of the cigarette head or the desired position of the cigarette head, the direction of incidence of the light and direction of the reflected light, as well as of the distances of these positions from the lens or from the optical system and from the detector, this deviation, which may be expressed as a distance, yields the distance of the irradiated region in relation to a desired position of this region.

The invention achieves a very high measuring accuracy. Furthermore, an instantaneous exposure of the cigarette head suffices for determining these distances. Consequently, a cigarette head can be measured as it moves and in a contactless fashion. This permits a high operating speed of the cigarette packaging or cigarette producing machine.

It is preferred to irradiate and evaluate a plurality of regions of a cigarette head. It is possible in this way to judge the correct construction, in particular of recess filter or Russian cigarettes and, in particular, to measure the length of a hollow section of a tip sleeve of such cigarettes. Furthermore, the correct, in particular round construction of such tip sleeves can be monitored by irradiating a plurality of points or relatively small regions onto the end region of a tip sleeve.

BRIEF DESCRIPTION OF THE DRAWING

Further preferred embodiments of the invention follow from the subclaims and with the aid of the exemplary embodiments illustrated in the drawing, in which:

DETAILED DESCRIPTION OF THE INVENTION

Figure 1:
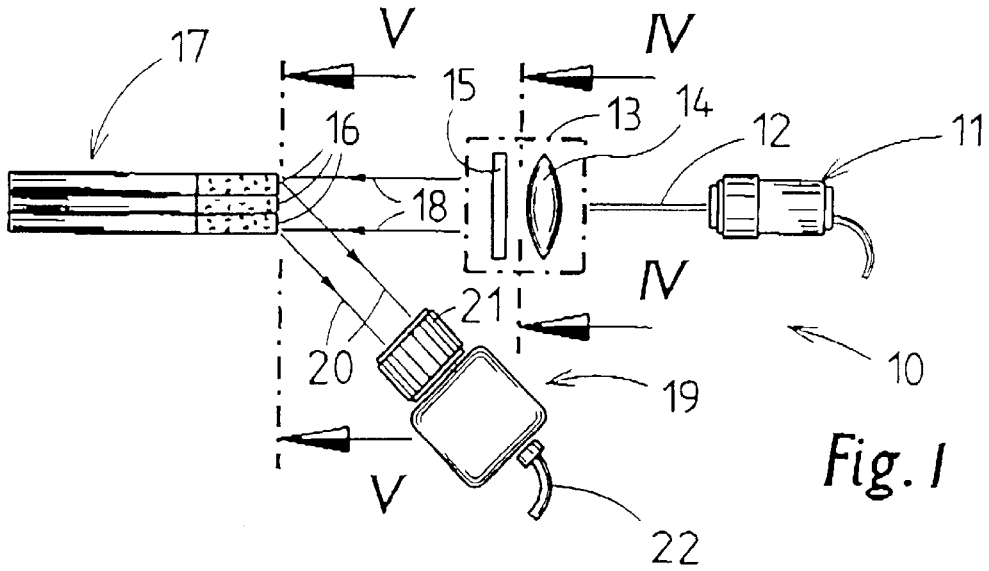
FIG. 1 shows a testing apparatus according to the invention for testing the heads of a cigarette formation, having a light source arranged directly upstream of a lens-stop system.

FIG. 1 shows a testing apparatus 10 for testing cigarette heads, having a light source in the form of a laser 11. In addition or alternatively, it is also possible to use other light sources having bright light which is monochromatic or non-monochromatic and non-coherent such as, for example, bright LEDs. The light source can shine permanently or be operated in a pulsed fashion in order to produce individual light flashes.

A light beam 12 emanating from the laser 11 strikes a lens-stop system 13 which has a lens 14 and a stop (diaphragm) 15 or mask. This lens-stop system 13 converts the light beam 12 into light 18 irradiating cigarette heads 16 of a cigarette formation 17. The irradiating light 18 is reflected by the cigarette heads 16. Located in a direction of reflecting is a detector 19, for example a CCD camera, that is to say a camera having a CCD chip, comprising a plurality of two-dimensionally arranged CCD elements, for producing a two-dimensional image with a multiplicity of pixels.

Reflected light 20 received by the detector 19 is arranged at a non-vanishing angle to the irradiating light 18, that is to say the light beams incident on the cigarette heads 16 are reflected to the detector 19 in a direction deviating from the direction of incidence. In addition to the CCD chip, the detector 19 also has an optical system 21, in particular a lens located therein. This optical system 21 serves the purpose of focusing the reflected light beams 20 onto the CCD chip. The detector 19 is connected via a cable 22 to an evaluation device in which the received image or images of the irradiated regions of the cigarette heads 16 are evaluated.

The cigarette formation 17 is tested in accordance with FIG. 1 as an overall, three-layer formation. Consequently, the detector 19 also detects the cigarette heads 16 of all cigarettes located inside the cigarette formation 17. The evaluation device must therefore evaluate an image comprising a number of partial images, specifically 20, corresponding to the number of cigarettes in the formation 17. This testing of the cigarette formation 17 preferably takes place on the cigarette turret of a cigarette packaging machine. If a defective cigarette is detected in this testing method, this leads to ejection of the corresponding defective cigarette formation 17.

Furthermore, it is also possible to investigate only a single cigarette. Such testing can also take place in the cigarette magazine of a cigarette packaging machine, in which case it is only individual cigarettes which are ejected, and not an entire cigarette formation 17. The ejection of individual cigarettes is then performed in accordance with the way described in the German Laid-Open Patent Application DE 36 20 735 A1, in particular with the aid of an apparatus explained there.

Figure 2:
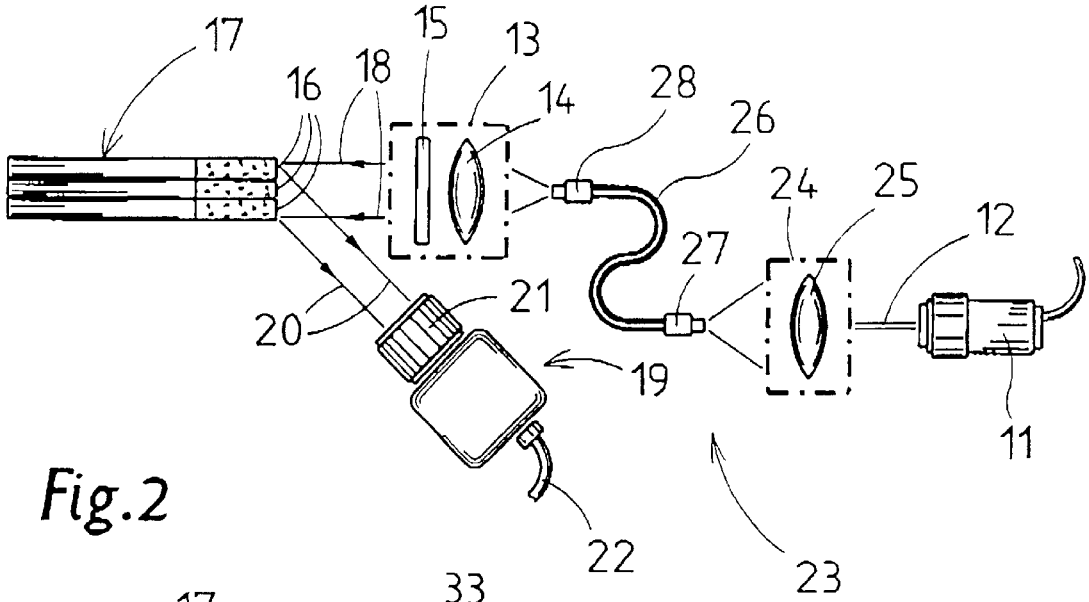
FIG. 2 shows a further testing apparatus according to the invention, having a glass fibre line for guiding light from a remote light source to a lens-stop system.

FIG. 2 shows a further testing apparatus 23, which corresponds to the testing apparatus 10 illustrated in FIG. 1, with the following exception: the light beam 12 does not pass directly to the lens-stop system 13, but is firstly guided via an optical system 24, in particular having a lens 25. This optical system 24 focuses the light beam 12 onto a glass fibre line 26 which has at its ends a section 27 for entry of the light coming from the optical system 24, and a section 28 for exit of the light coming from the glass fibre line 26. The light coming from the exit section 28 passes to the lens-stop system 13. The testing apparatus 23 corresponds otherwise to the testing apparatus 10 in accordance with FIG. 1, to the description of which reference is hereby made.

The glass fibre line 26 serves the purpose of enabling a light source 11 also to be arranged at a different location than in the immediate vicinity of the lens-stop system 13. This has the advantage that it is possible for some of the components of the testing apparatus 23 to be arranged where enough space is available. Other components, such as the lens-stop system 13, can then be accommodated in the immediate vicinity of the cigarette or cigarette formation 17. The detector 19 can be accommodated at a different location as appropriate. For this purpose, the detector 19 is likewise connected optically to the site of the cigarette testing, likewise via a glass fibre line. The reflected light 20 is then focused into an appropriate glass fibre line via a small optical system. This produces further space in the region of the cigarette or cigarette formation to be tested.

Alternatively, instead of the stops 15 illustrated in FIGS. 1 and 2, it is also possible to use a hologram in order to produce a structured light pattern on the cigarette heads 16 of the cigarette formation 17.

Figure 3:
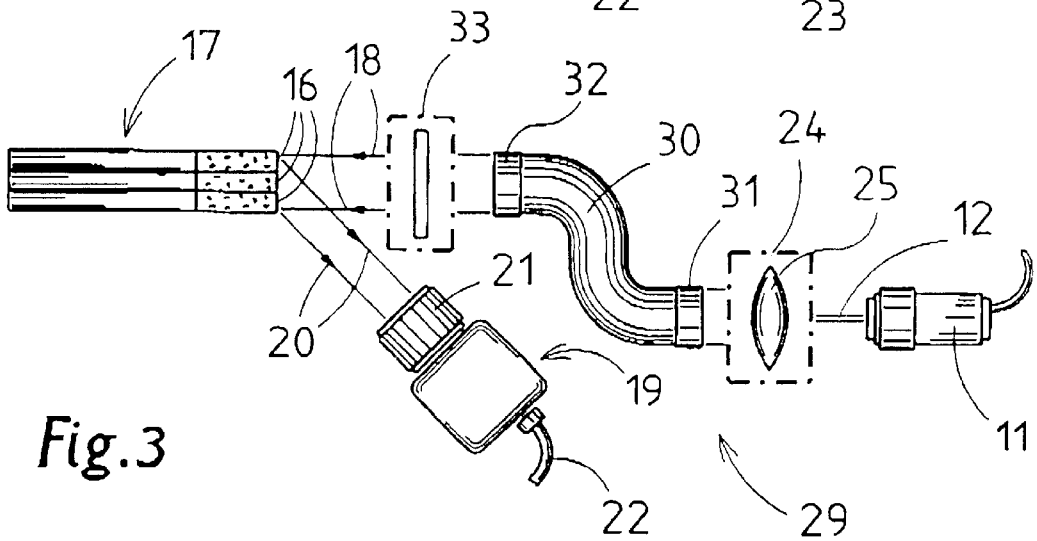
FIG. 3 shows a further testing apparatus according to the invention, having a glass fibre bundle for guiding light of a light source into the region of the cigarette ends.

FIG. 3 shows a further testing apparatus 29, which likewise has a light source 11. The light beam 12 emanating from the light source 11 is guided, in a fashion similar to FIG. 2, onto an optical system 24 having a lens 25. This lens 25 serves to focus the light beam 12 onto a bundle of glass fibre lines, or onto the individual fibres of a glass fibre line. The term glass fibre bundle 30 is used below generically for both variants, that is to say both for a bundle of individual glass fibre lines and for a glass fibre line having a multiplicity of individual glass fibres.

The glass fibre bundle 30 likewise has an entry section 31 for the entry of the light coming from the optical system 24, and an exit section 32 for the exit of the light originating from the glass fibre bundle 30. An apparatus 33 guides the light coming from the exit section 32 in the direction of the cigarette heads 16. The apparatus 33 serves either only to hold the exit section 32, or else only to arrange the fibres or glass fibre lines of the glass fibre bundle 30, in order to produce a specific structured light pattern on the cigarette heads 16. This is, in particular, an arrangement in accordance with the way illustrated in FIG. 4, the regions illustrated as relatively large circles respectively illustrating a bundle of glass fibres, while the regions illustrated as relatively small circles illustrate only a few or individual glass fibres.

Otherwise, the testing apparatus 29 illustrated in FIG. 3 corresponds to the testing apparatuses 10 and 23, to which reference is made, illustrated in FIG. 1 or 2. This holds, in particular, for the embodiment (not illustrated) of an additional glass fibre line from the cigarette heads 16 to the detector 19, that is to say for transporting the reflected light 20.

Figure 4:
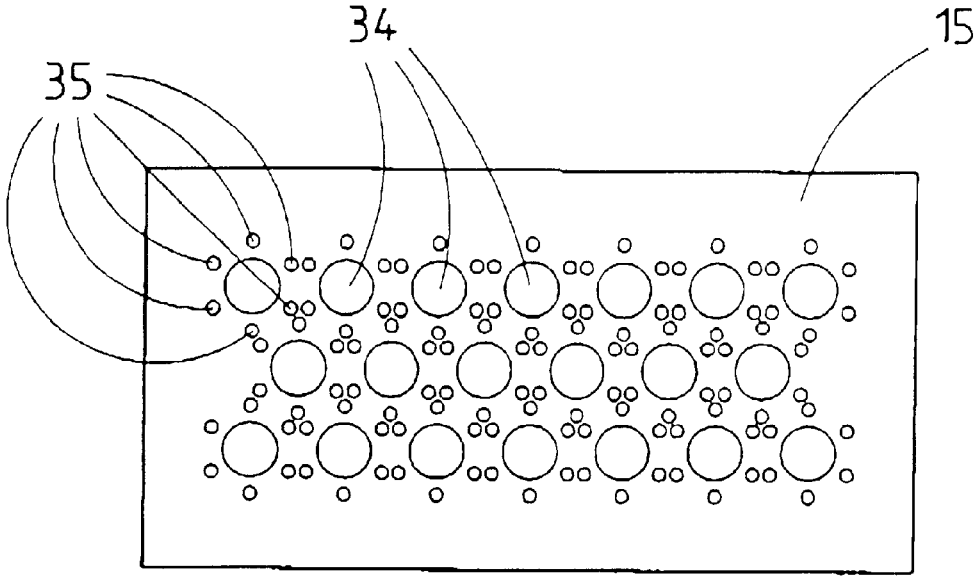
FIG. 4 shows a stop or arrangement of the glass fibre ends of the glass fibre bundle of FIG. 3, in accordance with a section along the line IV—IV in FIG. 1.

FIG. 4 shows the stop 15 in accordance with a section along the line IV—IV in FIG. 1. This stop 15 has three rows of relatively large openings 34, and a number of relatively small openings 35 arranged around the openings 34. This stop produces a structured light pattern on the cigarette heads. Each relatively large opening 34 corresponds to the central region of a cigarette located in a cigarette formation 17. This opening 34 serves the purpose of illuminating a large portion of the cigarette head, in particular essentially 40% to 90% of the surface of the end face of a cigarette head. This relatively large opening 34 serves the purpose of producing a light spot for testing the tobacco or the filter at the cigarette head 16. It has a diameter of 5 mm to 6 mm, for example, when the cigarette diameter is 8 mm, that is to say the ratio of the relatively large opening 34 to the cigarette diameter is 5%. Alternatively, the relatively large opening 34 can also be of polygonal or irregular construction.

In the example in accordance with FIG. 4, six relatively small circular openings 35 are provided in a fashion arranged circularly and concentrically with reference to the relatively large opening 34. They are located essentially at a distance from the centre of the relatively large opening 34 which corresponds to the cigarette radius, that is to say at a distance of approximately 4 mm from the centre of the relatively large opening 34 in the case of a cigarette having a diameter of 8 mm. These relatively small openings 35 serve the purpose of illuminating the end face of the cigarette paper or the external cigarette wrapping. This is either the cigarette paper itself, or else a paper-like section surrounding a cigarette filter.

Furthermore, however, it can also be a tip sleeve of a recess filter cigarette or a Russian cigarette. A recess filter cigarette is a filter cigarette in which the cigarette filter does not terminate with the cigarette paper, the filter being situated set back instead, with the result that a hollow tip is formed. A Russian cigarette is a similar cigarette, but without a filter, that is to say a filterless cigarette likewise has a hollow tip. The construction of this hollow tip can be tested with the aid of the apparatus according to the invention and the method according to the invention. In particular, it is possible according to the invention to scan and test the contour, that is to say the circular construction of the tip, in particular. However, it is also possible to determine the depth of the tip, specifically owing to the advantageous arrangement of at least one illuminated region of the centre of a cigarette head (specifically through the relatively large opening 34) and owing to the arrangement of one or more illuminated regions on the edge of the tip sleeve. A depth measurement is likewise performed using the distance-measuring method described here.

However, FIG. 4 also serves the purpose of the explanation, already mentioned above, of the apparatus 33, specifically of explaining the geometrical arrangement of individual glass fibres of the glass fibre bundle 30 for a testing apparatus 29 in accordance with the exemplary embodiment in accordance with FIG. 3. Here, a plurality of glass fibres are respectively combined to produce relatively large formations, arranged in three layers, in accordance with the relatively large opening 34. A smaller number of glass fibres are correspondingly arranged to produce a multiplicity of relatively small formations in accordance with the relatively small opening 35. Such a bundling or combination of glass fibres serves the purpose of producing a structured light pattern which corresponds to the light pattern produced by a stop 15 in accordance with FIG. 4.

Figure 5:
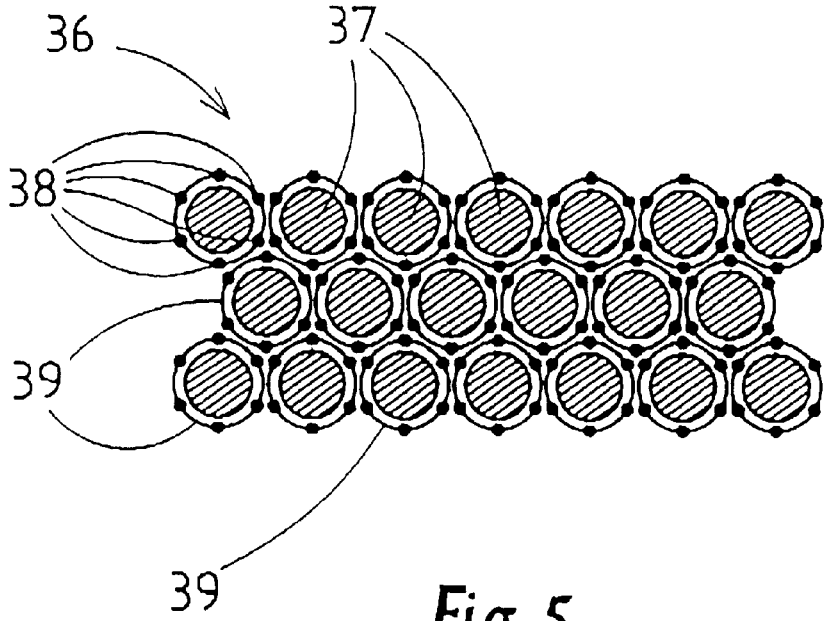
FIG. 5 shows the light pattern, yielded by the use of a stop or an arrangement of glass fibres in accordance with FIG. 4, on a 7/6/7 formation of 20 cigarettes, in accordance with a section along the line V—V in FIG. 1.

FIG. 5 is an illustration of the light pattern 36 resulting on the cigarette heads 16 of a cigarette formation 17, in an illustration of a section along the line V—V in FIG. 1. The light pattern 36 comprises a total of 20 relatively large, circular light spots 37 arranged in three layers, specifically in a 7/6/7 formation. Six relatively small light spots 38 are respectively arranged around these relatively large light spots 37 and are located on the outer wrapping 39 of the cigarette. The relatively large light spots 37 serve as evaluation surfaces for testing the tobacco-end or filter-end ends of the cigarette heads 16. By contrast, the relatively small light spots 38 serve as evaluation surfaces for the paper ends of the tip sleeves in the case of recess filter cigarettes and/or Russian cigarettes.

Figure 5A:
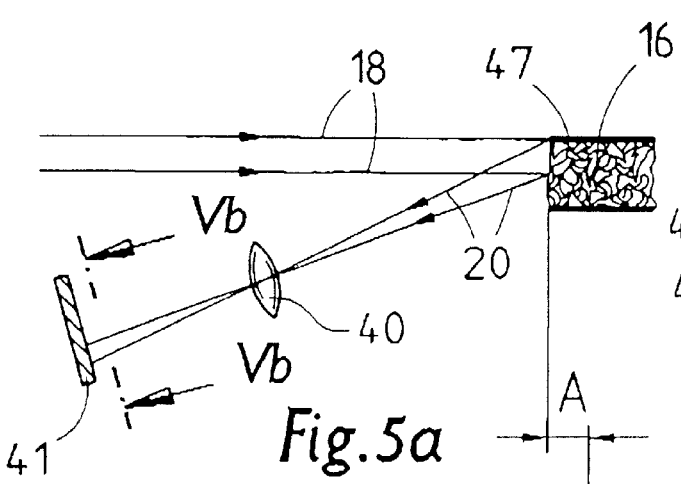
FIG. 5*a* shows the geometrical structure of an image of a correctly constructed cigarette on a detector.

FIG. 5*a* shows the geometrical structure of light 18 which irradiates a cigarette head 16 and passes as reflected light 20 onto a CCD chip 41 via a lens 40. The cigarette head 16 is located at its correct position in the position illustrated in FIG. 5*a*, and is also correctly constructed. In the case of such a correct cigarette, the result on the CCD chip 41 is a display 42 in accordance with FIG. 5*b* corresponding to a section along the line Vb—Vb in FIG. 5*a*. The display 42 shows a plurality of irradiated regions 43, specifically a relatively large region 44 and six relatively small regions 45 in a concentric arrangement therewith. The circular double line is an imaginary line for orientating and indicating the cigarette wrapping 47. All regions 43 or 44 and 45 respectively illuminate a multiplicity of CCD elements displayed in small squares. These CCD elements form an image, comprising a multiplicity of pixels, of the cigarette heads or of an entire cigarette formation.

Figure 5B:
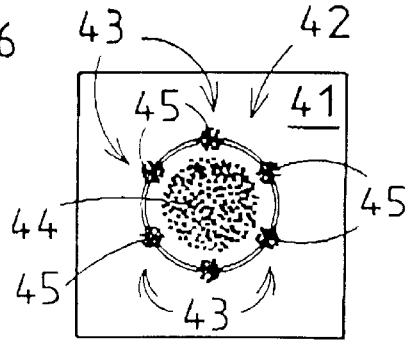
FIG. 5*b* shows the image resulting on the detector in the case of a geometrical arrangement in accordance with FIG. 5*a*, in the case of a section in accordance with the plane of section Vb—Vb.

The display 42 shown by way of example in FIG. 5*b* is arranged symmetrically with the CCD chip. Furthermore, the relatively small regions 45 are also arranged symmetrically or concentrically with the relatively large region 44. This symmetry indicates a correctly constructed cigarette of correct length. All images of irradiated regions of a cigarette head 16 are located at their expected position, since the correct cigarette head 16 is located at its desired position.

Figure 6A:
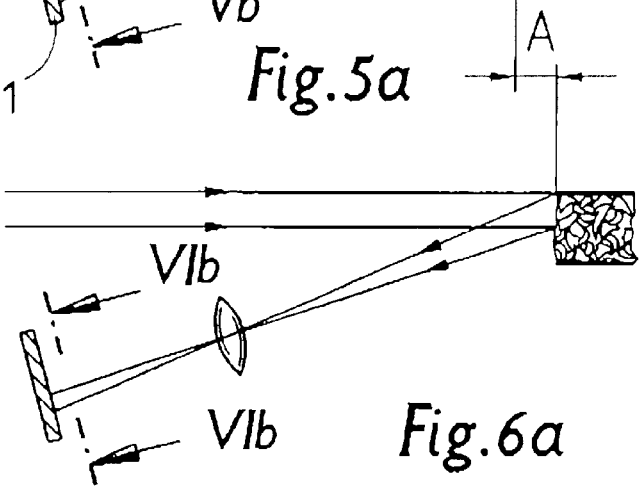
FIG. 6*a* shows the geometrical structure of an image of a cigarette which is too short on a detector.
Figure 6B:
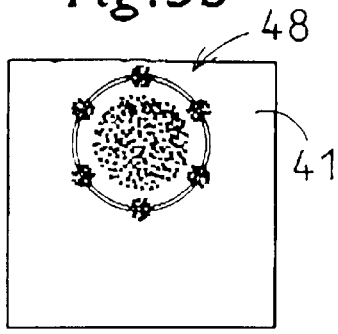
FIG. 6*b* shows the image resulting on the detector in the case of a geometrical arrangement in accordance with FIG. 6*a*, in the case of a section in accordance with the plane of section VIb—VIb.

By contrast, FIGS. 6*a* and 6*b* show the display 48 of a cigarette which is constructed too short by the length A. The display 48 corresponds essentially to the display 42. It is however, located in a different position, that is to say the regions 43 or 44 and 45 of the display 42 from FIG. 5*b*, specifically the images of the irradiated regions of tobacco and cigarette wrapping are no longer situated in the middle of the CCD chip 41, but are displaced upwards by comparison with the display 42 from FIG. 5*b*. This deviation, that is to say displacement, in particular the distance of this displacement is detected according to the invention by the evaluation device connected to the CCD chip. A desired position of these regions at the distance of the irradiated regions can then be determined from this deviation.

Figure 7A:
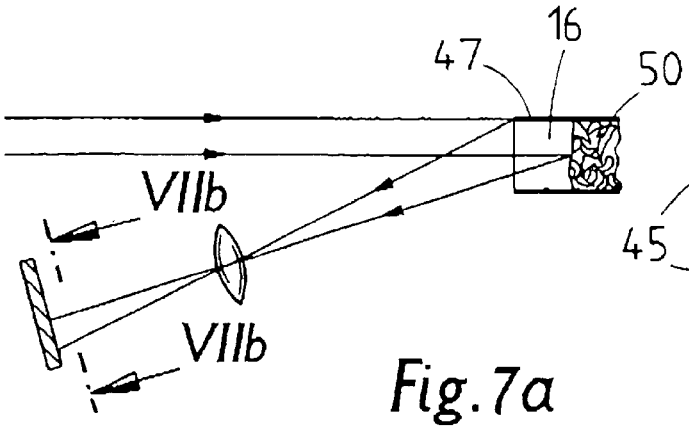
FIG. 7*a* shows the geometrical structure of an image of a cigarette of correct length but defective filling on a detector.
Figure 7B:
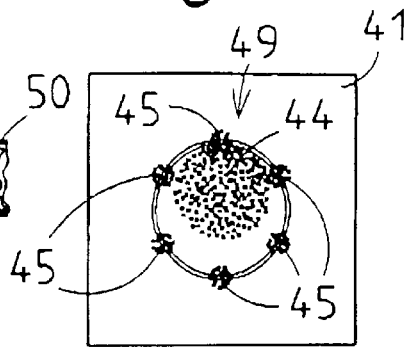
FIG. 7*b* shows the image resulting on the detector in the case of a geometrical arrangement in accordance with FIG. 7*a*, in the case of a section in accordance with the plane of section VIIb—VIIb.

FIGS. 7*a* and 7*b* correspondingly show the resulting display 49 of a cigarette of correct length and having a defective filling. As shown in FIG. 7*a*, at the cigarette head 16 the cigarette is not filled with tobacco 50 up to the end of the cigarette wrapping 47. This defective filling changes the display 49 by comparison with the displays 42 and 48 from FIGS. 5*b* and 6*b*, respectively. To be precise, the relatively large region 44 of FIG. 7*b* is now no longer arranged concentrically with the relatively small regions 45. The images of the irradiated regions, that is to say the relatively small and relatively large regions 45 and 44, are now no longer arranged symmetrically relative to one another. It is thereby possible to infer a defective cigarette. The depth of the hole, that is to say the absence of tobacco, can be concluded from the deviation of the relatively large region 44, that is to say from the displacement of this region by comparison with the display in FIG. 5*b*. The evaluation is performed in such a way that a cigarette is detected as defective in the case of overshooting predetermined limiting values of the deviation, or in the case of asymmetries, and this leads to the ejection of the cigarette or of the cigarette group containing this cigarette.

Figure 8A:
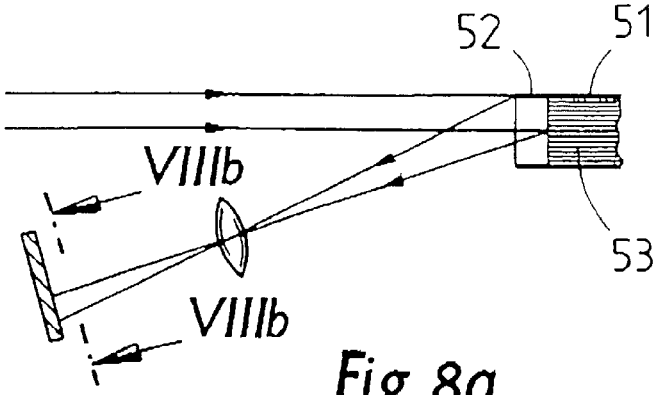
FIG. 8*a* shows the geometrical structure of an image of a recess filter cigarette of correct construction, on a detector.
Figure 8B:
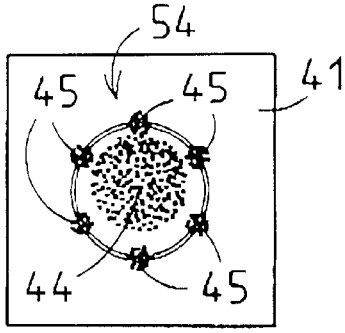
FIG. 8*b* shows the image resulting on the detector in the case of a geometrical arrangement in accordance with FIG. 8*a*, in the case of a section in accordance with the plane of section VIIIb—VIIIb.

Finally, FIGS. 8*a* and 8*b* show a recess filter cigarette 51 of correct construction. This recess filter cigarette 51 has a hollow tip 50 and a recessed filter 53. The centrally irradiated region of the recessed filter 53 is imaged as a relatively large region 44 on the CCD chip. By contrast, the relatively small regions 45, which result from illumination of the tip at six sites, do not form at sites situated concentrically with the relatively large region 44. This asymmetry of relatively small and relatively large regions 44 and 45 is a normal phenomenon in the case of recess filter cigarettes, but also in the case of Russian cigarettes, and is taken into account when evaluating the display 54 of the evaluation device.

A deviation in the display 54 from this expected position shown in FIG. 8*b* results in the case of defectively constructed recess filter cigarettes and/or Russian cigarettes. Such a deviation can likewise be tolerated within specific limiting values. Only upon overshooting of predetermined limiting values is the corresponding cigarette or an entire cigarette formation ejected.

In the case of a variant which is not illustrated, two of the previously explained testing apparatuses are provided at both ends of the cigarettes. It is possible in this way to detect the correct construction of a correctly constructed cigarette even in the case of an axial displacement thereof, since the overall length of a cigarette can be inferred on the basis of the determined distance of an end of the cigarette from its desired position at either end, respectively. It is thereby possible advantageously to prevent the ejection of inherently correct cigarettes which are, however, slightly displaced axially.

The invention opens up a multiplicity of possibilities in testing cigarette heads, with the result that it is possible to detect not only defective tobacco locations, but also the depth of tips in the case of recess filter cigarettes and/or Russian cigarettes, as well as the construction of the tip itself, that is to say whether the latter is really circular or deformed. Finally, the invention can also be used to determine the length of a cigarette exactly.

LIST OF REFERENCE SYMBOLS

| | |
|---|---|
| 10 | Testing apparatus |
| 11 | Laser |
| 12 | Light beam |
| 13 | Lens-stop system |
| 14 | Lens |
| 15 | Stop |
| 16 | Cigarette head |
| 17 | Cigarette formation |
| 18 | Irradiating light |
| 19 | Detector |
| 20 | Reflected light |
| 21 | Optical system |
| 22 | Cable |
| 23 | Testing apparatus |
| 24 | Optical system |
| 25 | Lens |
| 26 | Glass fibre line |
| 27 | Entry section |
| 28 | Exit section |
| 29 | Testing apparatus |
| 30 | Glass fibre bundle |
| 31 | Entry section |
| 32 | Exit section |
| 33 | Apparatus |
| 34 | Relatively large opening |
| 35 | Relatively small opening |
| 36 | Light pattern |
| 37 | Relatively large light spot |
| 38 | Relatively small light spot |
| 39 | Outer wrapping |
| 40 | Lens |
| 41 | CCD chip |
| 42 | Display |
| 43 | Region |
| 44 | Relatively large region |

-continued

| | |
|---|---|
| 45 | Relatively small region |
| 46 | Circular double line |
| 47 | Cigarette wrapping |
| 48 | Display |
| 49 | Display |
| 50 | Tobacco |
| 51 | Recess filter cigarette |
| 52 | Hollow tip |
| 53 | Recessed filter |
| 54 | Image |
| A | Length |

What is claimed is:

1. An apparatus for testing a cigarette head (16), having a light source (11) and an optical system (13–15) for producing at least one region (37, 38), irradiated with light, on a cigarette head (16), and having a detector (19), for receiving light (20) reflected by the cigarette head (16), which is arranged so that the irradiating light and the received reflected light (18, 20) run at an angle to one another, and so that the irradiated region (37, 38) can be imaged on the detector (19), said apparatus further comprising an evaluation device which evaluates a signal generated by the detector (19) in order to determine a possible deviation in a position, of the image (43, 44, 45) of the irradiated region (37, 38), from an expected position of an image of a corresponding region of an ideal cigarette head, in order to determine, from the deviation, the distance of the irradiated region (37, 38) from a desired position thereof; and an optical system (13) for producing a structured light pattern on the cigarette head (16).

2. The apparatus according to claim 1, further comprising a glass fibre line (26, 30) for guiding light, which is to be emitted, from the light source (11) in the direction of the cigarette head (16) to the optical system.

3. The apparatus according to claim 1, characterized by a glass fiber line for guiding reflected light to the detector (19).

4. The apparatus according to claim 1, characterized by a bundle (30) of glass fiber lines for guiding light, which is to be emitted, from the light source (11) in the direction of the cigarette head (16), said bundle being bundled in such a way that its ends are widened to produce a structured light pattern on the head (16).

5. The apparatus according to claim 1, characterized by a CCD chip, assigned to the detector (19), having a multiplicity of two-dimensionally arranged CCD elements for producing a two-dimensional image (42) with a multiplicity of pixels.

6. The apparatus according to claim 1, characterized by one light source (11) and one detector (19) each in a region of opposite ends of the cigarette, for testing both ends of a cigarette.

7. A method for testing a cigarette head (16), at least one region (37, 38) of the cigarette head (16) being irradiated with light (18), and light (20) reflected by the cigarette head (16) being received by a detector (19) so that the irradiating light and the received reflected light (18, 20) run at an angle to one another, so that the irradiated region (37, 38) is imaged on the detector (19), and so that a signal generated by the detector (19) is evaluated, said method comprising the steps of:

during evaluation, determining a possible distance of an actual position of the image (43, 44, 45) of the irradiated region (37, 38) from an expected position of an image of a corresponding region of an ideal cigarette head on the detector (19);

using the deviation to determine the distance of the irradiated region (37, 38) from a desired position thereof; and irradiating and evaluating a plurality of regions (37, 38).

8. The method according to claim 7, further comprising the steps of, upon overshooting of a predetermined distance of the irradiated region (37, 38) from the desired position thereof, ejecting the tested cigarette.

9. The method according to claim 7, further comprising the step of, for an asymmetric arrangement of images (43, 44, 45) of irradiated regions (37, 38) of a cigarette filled up to opposite ends thereof with tobacco (50) or a filter (53), ejecting said cigarette.

10. The method according to claim 7, wherein at least one cigarette end of a cigarette is not filled up with tobacco (50) or a filter (53), said method, for asymmetrical images (43, 44, 45) of irradiated regions (37, 38), further comprising the step of ejecting said cigarette only if the asymmetry exceeds predetermined limiting values.

11. The method according to claim 7, further comprising the step of determining the length of a hollow section of a tip sleeve (52) of a recess filter or Russian cigarette (51) from at least one distance of an image (45) of a cigarette wrapping region from an image (44) of a region (37) inside the cigarette wrapping (47).

12. The method according to claim 7, wherein both ends of a cigarette are tested, said method further comprising the step of determining the actual cigarette length from the distances of the irradiated regions (37, 38) from their respective desired positions, taking into account the distance of the two cigarette end desired positions, with the result that the longitudinal length of a cigarette is determined even when the position thereof is displaced in the longitudinal direction.

13. The method according to claim 7, further comprising the step of choosing the plurality of regions (37, 38) to be at least one region (37), inside a cigarette end surrounded by a cigarette wrapping, and at least one other region (38) on the cigarette wrapping.

14. An apparatus, for testing cigarette heads (16), comprising:

a light source (11) and an optical system (13–15) for producing regions (37, 38), irradiated with light, on a cigarette head (16);

a detector (19) for receiving light (20) reflected by the cigarette head (16), and arranged so that the irradiating light and the received reflected light (18, 20) run at an angle to one another and so that the irradiated region (37, 38) can be imaged on the detector (19);

an evaluation device which evaluates a signal generated by the detector (19) in order to determine a possible deviation in the actual position of the image (43, 44, 45) of the irradiated region (37, 38) from an expected position of an image of a corresponding region of an ideal cigarette head in order to determine, from the deviation, the distance of the irradiated region (37, 38) from a desired position thereof; and a glass fiber bundle (30) for guiding light, which is to be emitted, from the light source (11) in the direction of the cigarette head (16), said bundle (30) being bundled in such a way that ends thereof are widened to generate a structured light pattern, on the cigarette head (16), encompassing a plurality of separate regions (37, 38).

15. The apparatus according to claim 14, characterized by an optical system (13) for producing the structured light pattern, on the cigarette head (16), with a plurality of regions (37, 38) on a cigarette wrapping and inside the cigarette wrapping.

16. The apparatus according to claim 14, characterized by a glass fiber line for guiding the reflected light to the detector (19).

17. The apparatus according to claim 14, characterized by a CCD chip, assigned to the detector (19), having a multiplicity of two-dimensionally arranged CCD elements for producing a two-dimensional image (42) with a multiplicity of pixels.

18. The apparatus according to claim 14, characterized by one light source (11) and one detector (19), each in a region of opposite ends of the cigarette, for testing both ends cigarette.

* * * * *